US005967649A

United States Patent [19]

Schlesinger

[11] Patent Number: 5,967,649

[45] Date of Patent: Oct. 19, 1999

[54] LIGHTING DEVICE ADAPTED TO BE POSITIONED AT ANY POINT ALONG AN ELECTRICAL CORD

[76] Inventor: Robert A. Schlesinger, 1841 San Ysidro Dr., Beverly Hills, Calif. 90210

[21] Appl. No.: 09/148,407

[22] Filed: Sep. 4, 1998

[51] Int. Cl.[6] ..... F21V 21/00

[52] U.S. Cl. ..... 362/391; 362/84

[58] Field of Search ..... 362/84, 391, 234, 362/253, 226

[56] References Cited

U.S. PATENT DOCUMENTS

| | | | |
|---|---|---|---|
| 1,219,497 | 3/1917 | Smith . | |
| 1,909,412 | 5/1933 | Ludwig . | |
| 2,079,801 | 5/1937 | Grant | 176/32 |
| 2,692,375 | 10/1954 | Carson | 339/99 |
| 2,987,694 | 6/1961 | Eskenazi et al. | 339/99 |
| 3,061,716 | 10/1962 | Benander | 240/73 |
| 3,231,731 | 1/1966 | McDonald | 240/3 |
| 3,307,030 | 2/1967 | De Francisco | 240/73 |
| 3,456,104 | 7/1969 | Williams | 240/88 |
| 3,860,739 | 1/1975 | Kloth et al. | 174/48 |
| 4,075,758 | 2/1978 | Parsons et al. | 29/628 |
| 4,547,033 | 10/1985 | White et al. | 339/97 R |
| 4,653,829 | 3/1987 | LaMont | 339/97 L |
| 4,763,232 | 8/1988 | Woodside | 362/391 X |
| 4,779,177 | 10/1988 | Ahroni | 362/236 |
| 4,826,448 | 5/1989 | Maddock | 439/409 |
| 5,086,379 | 2/1992 | Denison et al. | 362/145 |
| 5,330,368 | 7/1994 | Tsuruzono | 439/409 |
| 5,662,408 | 9/1997 | Marischen | 362/226 |

*Primary Examiner*—Stephen Husar
*Attorney, Agent, or Firm*—Jeffer, Mangels, Butler & Marmaro LLP

[57] ABSTRACT

A light assembly adapted to be removably affixed to an electrical cord at any point along the length of the cord. The light assembly generally includes a housing and a lighting element. The housing has a cord channel adapted to receive the electrical cord, and first and second electrical conductors, each having first and second ends, respectively. The first ends of the first and second electrical conductors protrude into the cord channel. The lighting element is in electrical communication with the first and second electrical conductors.

19 Claims, 10 Drawing Sheets

10
16a
16

50
52
48
16b
16c
14
58
58
28b
56a
56a
58
58
56a
26
56a
26b
26a
12
22
22
20
12
18
28a
24a
24
36
56b
60
60
44
56b
38b
60
24b
46
42a
12
34
38b
42
60

FIG. 4A
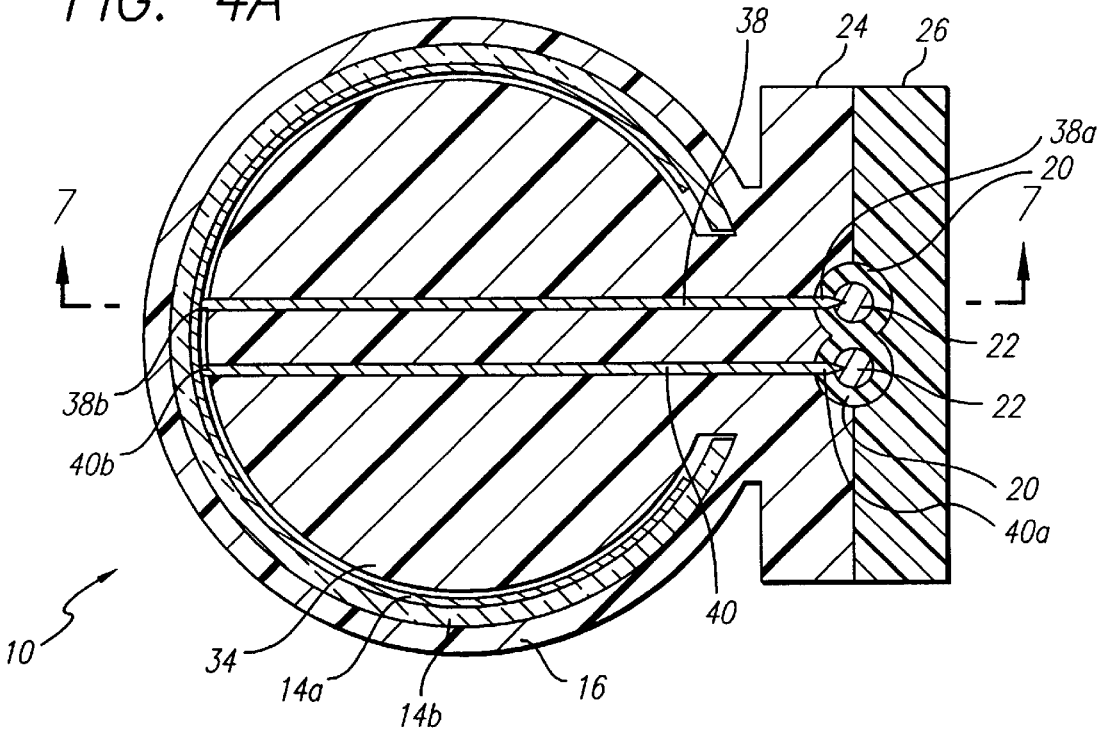
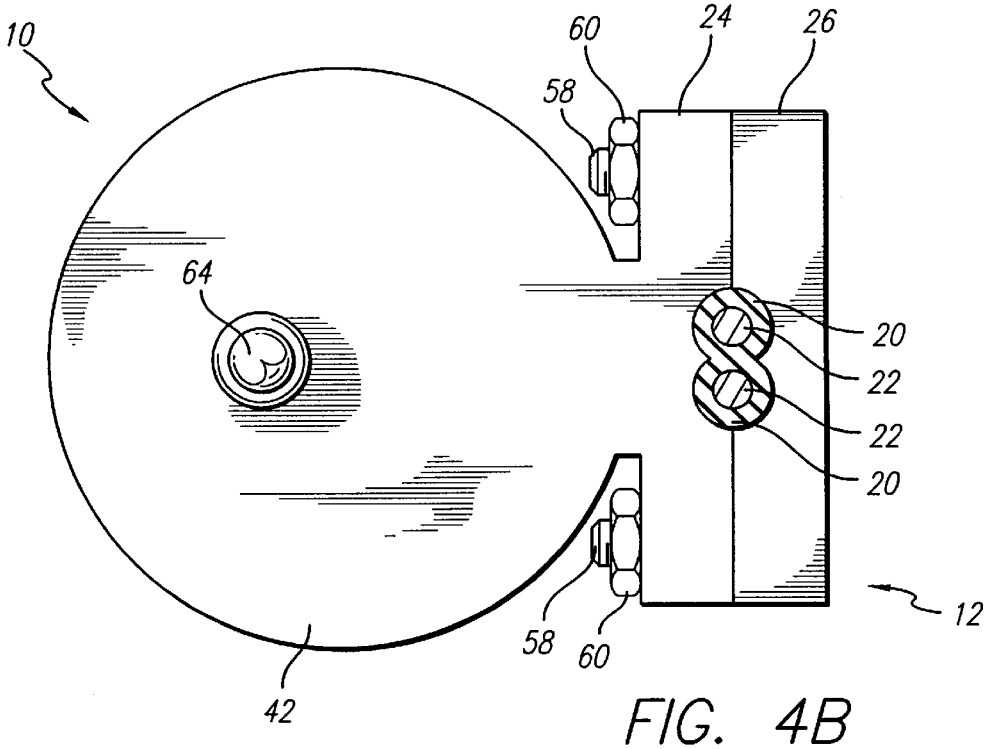
FIG. 4B

LIGHTING DEVICE ADAPTED TO BE POSITIONED AT ANY POINT ALONG AN ELECTRICAL CORD

FIELD OF THE INVENTION

The present invention relates to lights and more particularly to a night light that is adapted to tap into the current of an electrical cord at any desired point along the cord.

BACKGROUND OF THE INVENTION

It is often advantageous to provide light in a dark room, while at the same time not disturbing a person while sleeping. Typically, this is accomplished using night lights, which are small lamps generally in the range of 4 to 7 watts. Incandescent lamps, light emitting diodes (LED's), neon lamps, and electroluminescent materials are commonly used in night lights. However, heretofore night lights have been plugged directly into an electrical outlet, and thus their location has always been fixed and located on walls. Electrical outlets are generally located on walls just above the floor and are frequently blocked by sofas, desks, beds and other household furniture. This makes placement of a typical night light very limited.

Other night lights are built into electrical switches, outlets or cover plates for installation on an electrical switch or outlet. The installation and placement of such night lights are also restricted to the location of an electrical outlet or switch.

Switches are usually located at the entrance of a room and thus not where a person may wish the night light to be. In rooms such as bathrooms and kitchens, electrical outlets are usually located on walls at counter height where night lights can be placed close to a counter top or work area. But, in living rooms, dens, bedrooms, offices and other work rooms, electrical outlets are frequently located behind household furniture items. If a night light is installed or plugged into an electrical outlet in such a location, it is useless as a source of light for illuminating an area in a room. Furthermore, in a typical kitchen or bathroom the few outlets that are located at counter level are often being used by the wide variety of kitchen and bathroom appliances. It is desirable to provide a night light that can still be used when all outlets in a particular room are already in use without disconnecting an appliance.

A night light that could be placed in locations other than near an electrical outlet would be advantageous.

A need exists for a low power night light that can be positioned anywhere along an electrical cord which has one end plugged into an electrical outlet and the other end operating an appliance, e.g. a floor lamp or television.

SUMMARY OF THE INVENTION

In accordance with one aspect of the present invention, there is provided a light assembly adapted to be removably positioned on an electrical cord having a length, at any point along the length. The light assembly generally comprises a pair of electrical conductors adapted to tap into the electrical cord at a point, and a light emitting device which electrically engages the pair of electrical conductors. The light assembly is adapted to be positioned to provide light at the point along the electrical cord.

In accordance with another aspect of the present invention, there is provided an electrical appliance including an electrical cord having a length and first and second opposite ends, which at the first end is electrically connected to the electrical appliance and at the second end is plugged into an electrified electrical outlet. The electrical appliance includes a light assembly having an electrical tap and a light emitting device, wherein the electrical tap electrically connects the light emitting device to the electrical cord at a selected point along the length of the electrical cord.

In accordance with yet another aspect of the present invention, there is provided a light assembly adapted to be removably affixed to an electrical cord having a length, at any point along the length of the cord. The electrical cord has opposite ends and an insulation cover surrounding two electrical supply wires. The light assembly generally comprises a housing having a cord channel adapted to receive the electrical cord, and a lighting element. The housing also includes first and second electrical conductors each having a first and second end, respectively, wherein the first ends of said first and second electrical conductors protrude into said cord channel. The lighting element is in electrical communication with the first and second electrical conductors.

In a preferred embodiment, the housing includes opposing front and back portions that are secured to one another and cooperate to form the cord channel. The front and back portions of the housing each have a portion of the cord channel defined therein.

In additional preferred embodiments, the light assembly includes a light sensor switching circuit, and the lighting element is an electroluminescent sheet or a light emitting diode or an incandescent light or a fluorescent light.

Other objects, features and advantages of the present invention will become apparent to those skilled in the art from the following detailed description. It is to be understood, however, that the detailed description and specific examples, while indicating preferred embodiments of the present invention, are given by way of illustration and not limitation. Many changes and modifications within the scope of the present invention may be made without departing from the spirit thereof, and the invention includes all such modifications.

BRIEF DESCRIPTION OF THE DRAWINGS

The invention may be more readily understood by referring to the accompanying drawings in which:

FIG. 4A is a bottom sectional plan view of the assembled light assembly taken along line 4—4 of FIG. 3 showing the two electrical conductors piercing the insulation cover of the electrical cord, and engaging the electroluminescent sheet.

FIG. 4B is a bottom plan view of the light assembly showing the location of the photocell sensor, in accordance with a first preferred embodiment of the present invention.

Like numerals refer to like parts throughout the several views of the drawings.

DETAILED DESCRIPTION OF THE PREFERRED EMBODIMENTS

Figure 1:
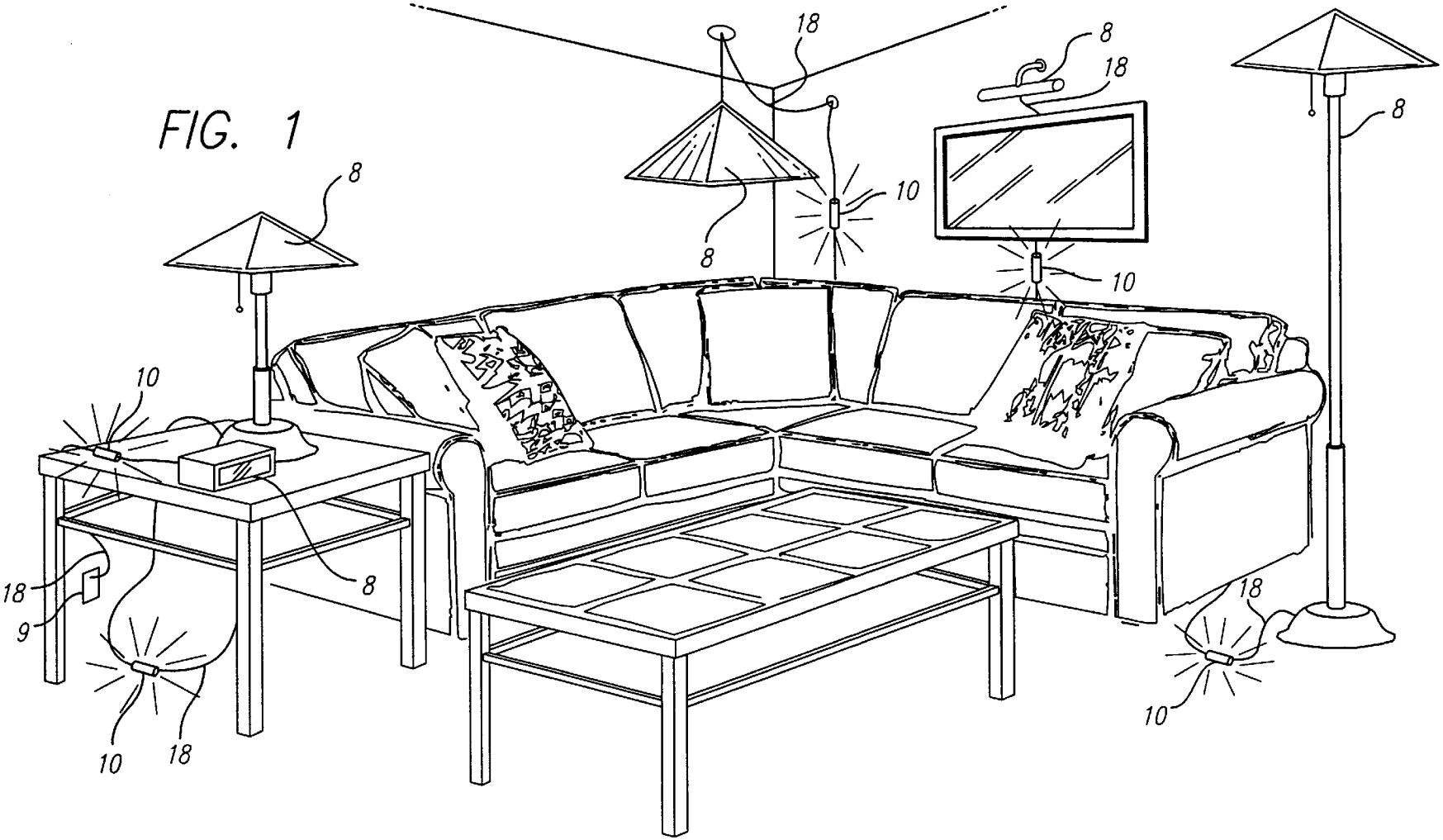
FIG. 1 is a pictorial illustration of a room in a home showing a number of typical applications of the light assembly in accordance with a first preferred embodiment of the present invention.

Referring to FIGS. 1–9, a first preferred embodiment of a light assembly, generally designated 10 in the Figures, is adapted to tap into the current of an electrical cord. The light assembly 10 generally includes a housing 12, an electroluminescent sheet 14, and an outer cover 16.

Figure 2:
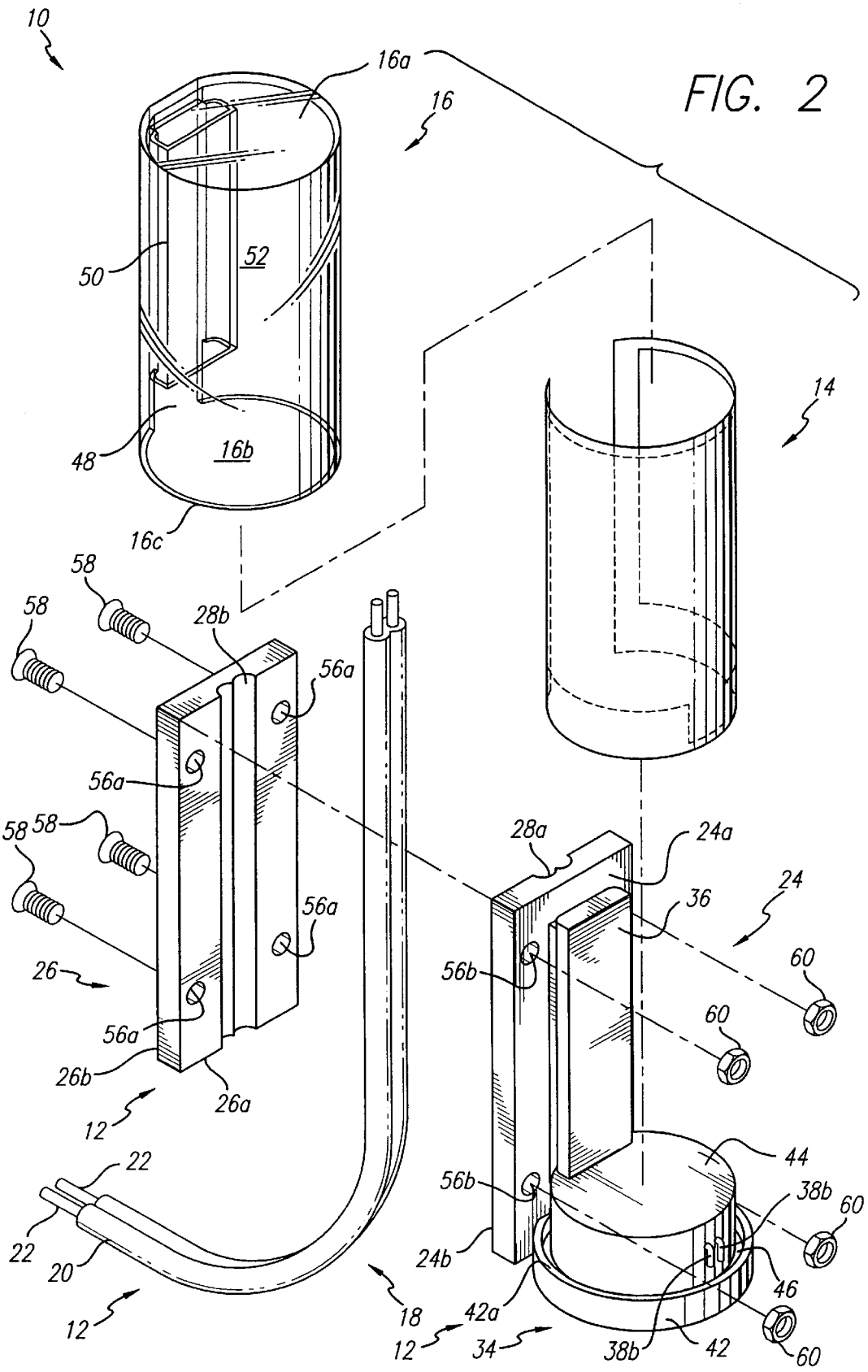
FIG. 2 is an exploded perspective view of the separate components of the light assembly, including front and rear portions of the housing, the outer cover and the electroluminescent sheet, in accordance with a first preferred embodiment of the present invention.
Figure 3:
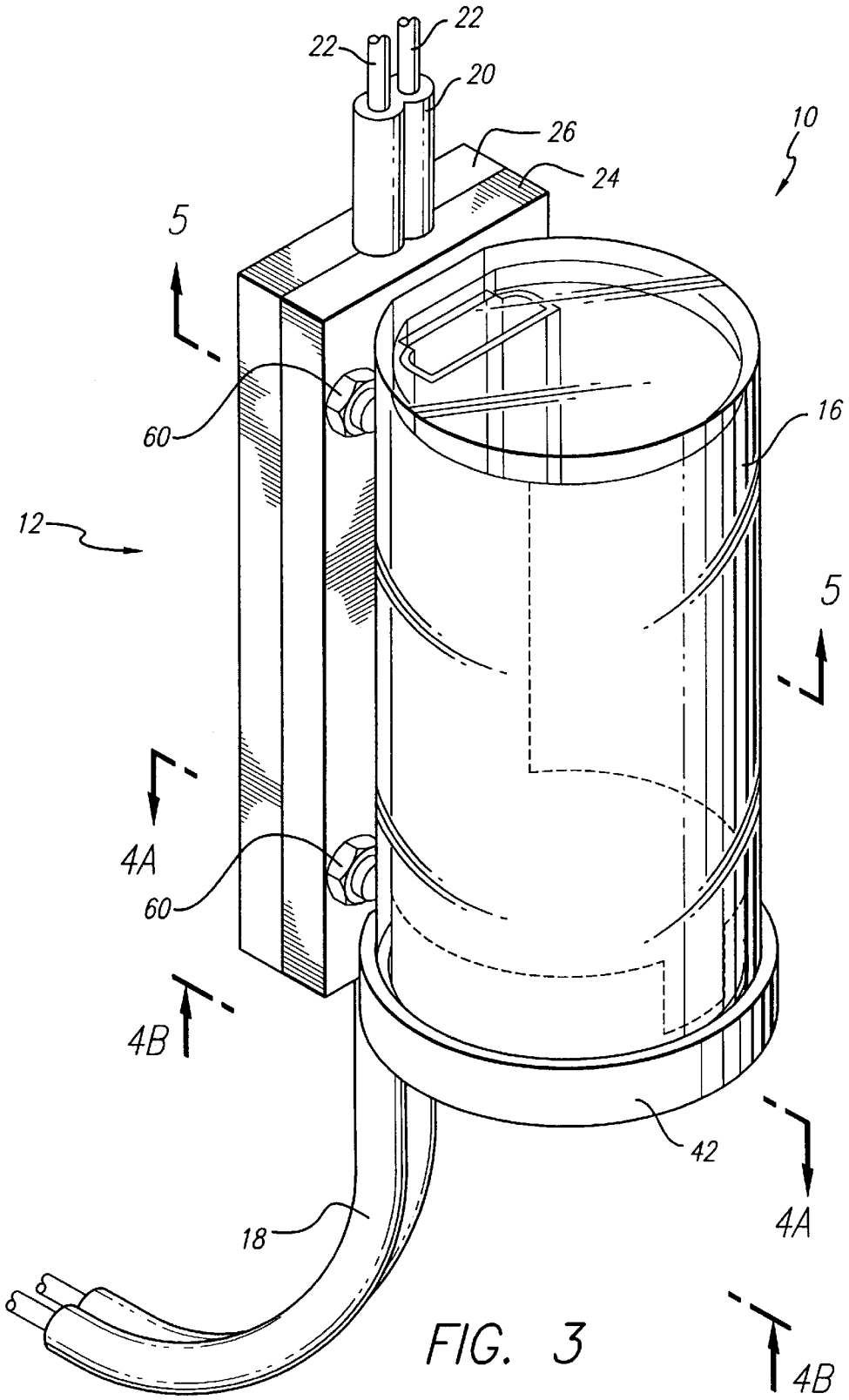
FIG. 3 is a perspective view of the device of FIG. 2 fully assembled and clamped to an electrical cord.
Figure 5:
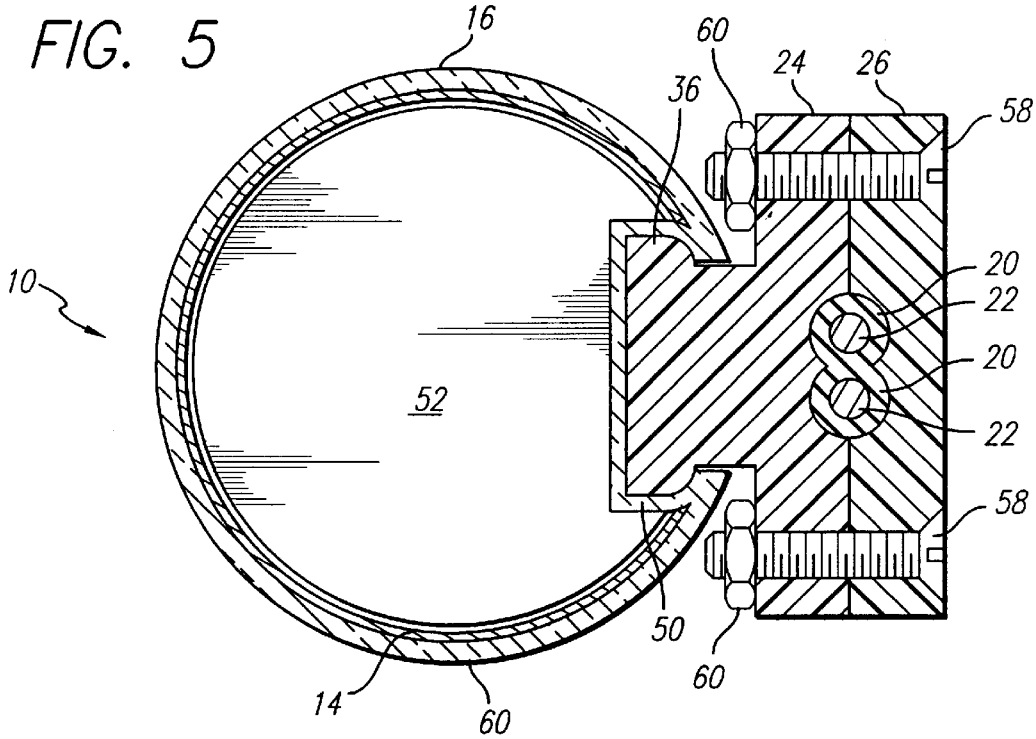
FIG. 5 is a top sectional plan view of the assembled light assembly taken along line 5—5 of FIG. 3 illustrating how the electroluminescent sheet and the outer cover are engaged.

Preferably, the housing 12 is adapted to surround a conventional electrical cord 18. The electrical cord 18 has an insulation cover 20 that surrounds two electrical supply wires 22 and extends from an electrical appliance 8, e.g., a floor lamp, television, etc., to an electrical outlet 9, as shown in FIG. 1. The electrical cord 18 is electrically connected at one end to the electrical appliance 8 and at the other end is plugged into (or is adapted to be plugged into) an electrified electrical outlet 9. The electrical appliance 8 is any device which is operable by plugging an electrical cord having a length extending therefrom into a source of alternating current, such as an electrical outlet. The housing 12 preferably includes front and back portions 24 and 26 that cooperate to form a cord channel 28. The cord channel 28 is adapted to receive the electrical cord 18. The front and back portions 24 and 26 of the housing 12 each have a portion 28*a* and 28*b* of the cord channel 28 defined therein, as shown in FIG. 2.

The front portion 24 of the housing 12 has opposed front and back sides 24*a* and 24*b*. A portion of the cord channel 28*a* preferably extends longitudinally along the back side 24*b* of the front portion 24 of the housing 12. It will be understood that the cord channel 28 can be shaped to receive any electrical cord, and the shape of the cord channel 28 is not a limitation on the present invention.

The front side 24*a* of the front portion 24 of the housing 12 preferably includes a base unit 34 extending therefrom and a mounting portion 36, preferably spaced above the base unit 34, which is adapted to slidably receive the outer cover 16. In the first preferred embodiment, the mounting portion 36 extends longitudinally along the front side 24*a* of the front portion 24 of the housing 12. However, it should be understood that any means for mounting the outer cover 16 on the housing 12 is within the scope of the invention. For example, the outer cover 16 can be secured to the housing 12 by screws, glue, snaps or other physical attachment structures or devices known to those skilled in the art.

Figure 6:
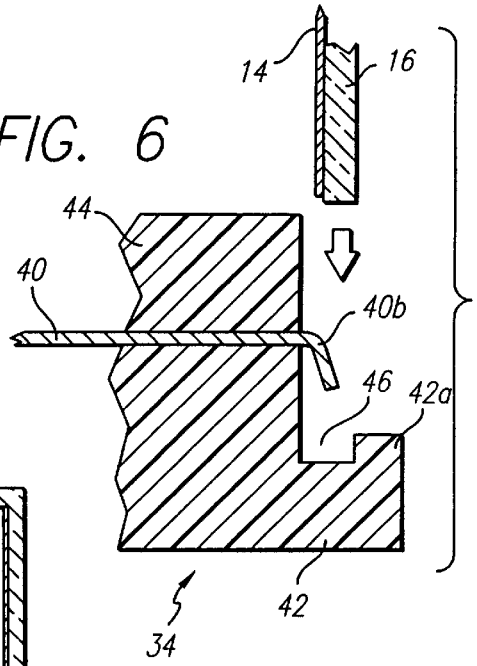
FIG. 6 is a sectional side view of the front portion of the housing detailing the electrical conductors before engagement with the electroluminescent sheet.
Figure 7:
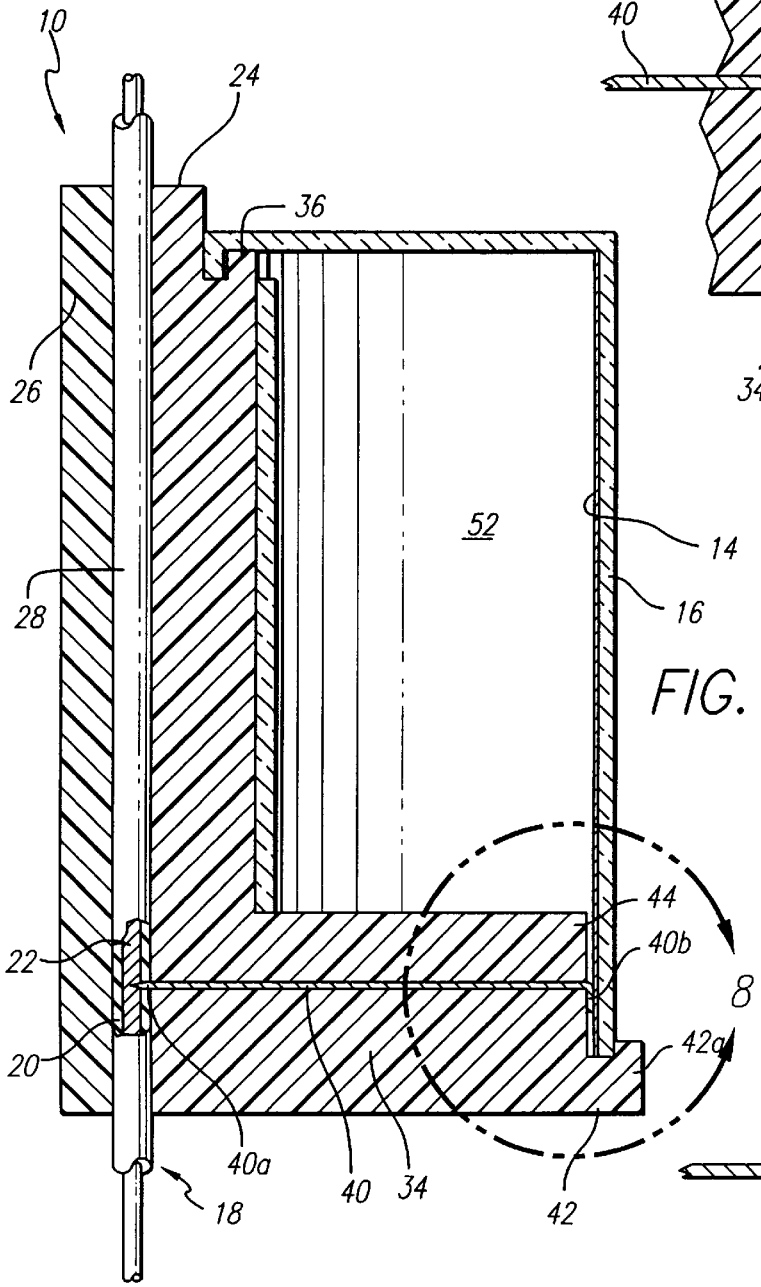
FIG. 7 is a sectional side view of the assembled light assembly taken along line 7—7 of FIG. 4 in accordance with a first preferred embodiment of the present invention.

The base unit 34 includes first and second electrical conductors 38 and 40 each having first and second ends 38*a*, 40*a* and 38*b*, 40*b*, respectively, extending transversely therethrough, as shown in FIG. 4. The first ends 38*a* and 40*a* of the electrical conductors 38 and 40 protrude into the cord channel 28 and are preferably sharp, thereby being adapted to pierce the insulation cover 20 of an electrical cord 18. In use, the first ends 38*a* and 40*a* of the electrical conductors 38 and 40 pierce the insulation cover 20 of the electrical cord 18 and electrically engage the current supply wires 22, thereby tapping into the electrical cord 18 and supplying current to the electrical conductors 38 and 40. The point at which the first ends 38*a* and 40*a* of the electrical conductors 38 and 40 pierce the insulation cover 20 of the electrical cord 18 and make contact with the current supply wires 22 is commonly referred to as a tap or electrical tap. It will be understood that to create the electrical tap the current supply wires 22 do not have to be severed. The second ends 38*b* and 40*b* of the electrical conductors 38 and 40 preferably extend out of the base unit 34 and are adapted to electrically engage the electroluminescent sheet 14. Preferably, the second ends 38*b* and 40*b* are bent downwardly, as shown in FIG. 6.

In the first preferred embodiment, the base unit 34 is generally circular in shape, and includes a major portion 42 and a minor portion 44. However, it will be understood that the base unit can be any other regular or irregular geometric shape, such as square, rectangular, or triangular, etc. Preferably, the first and second electrical conductors 38 and 40 extend through the minor portion 44 of the base unit 34. The major portion 42 has a flange 42*a* that extends upwardly therefrom, thereby defining a mounting channel 46 between the minor portion 44 and the flange 42*a*, as shown in FIGS. 2 and 6. The mounting channel 46 is adapted to receive the bottom edge 16*c* of the outer cover 16.

The back portion 26 of the housing 12 has front and back sides 26*a* and 26*b*. A portion of the cord channel 28*b* preferably extends longitudinally along the front side 26*a* of the back portion 26 of the housing 12. The back portion 26 of the housing 12 also preferably includes apertures 56*a* defined therein that correspond to apertures 56*b* on the front portion 24 of the housing 12, as shown in FIG. 2.

Preferably the housing 12 is comprised of a plastic resin, however it should be understood that the housing can be comprised of other plastics or other rigid materials known in the art.

Preferably, the outer cover 16 is generally cylindrical in shape, with the top 16*a* of the cylinder being closed and an opening 16*b* being defined at the bottom. However, the shape of the outer cover 16 is not meant to be a limitation on the present invention and it will be understood that the outer cover 16 is shaped to correspond to the base unit 34 and vice versa. For example, if the base unit is square, the outer cover is box shaped. In the first preferred embodiment, the outer cover defines a slot 48 that preferably extends longitudinally from the bottom opening 16*b* to the top 16*a*. A mounting member 50 spans across slot 48 and extends longitudinally along at least a portion of the slot 48. The mounting member 50 preferably protrudes into the interior 52 of the outer cover 16, as shown in FIG. 2. However, alternatively, it can also protrude outside of the outer cover 16. The slot 48 and the mounting member 50 cooperate to slidably engage the mounting portion 36 of the front portion 24 of the housing 12. In the first preferred embodiment, the outer cover 16 is comprised of a clear or translucent plastic, such as acrylic, polycarbonate or similar clear resins; however, the material of the outer cover 16 is not a limitation of the present invention.

Figure 9:
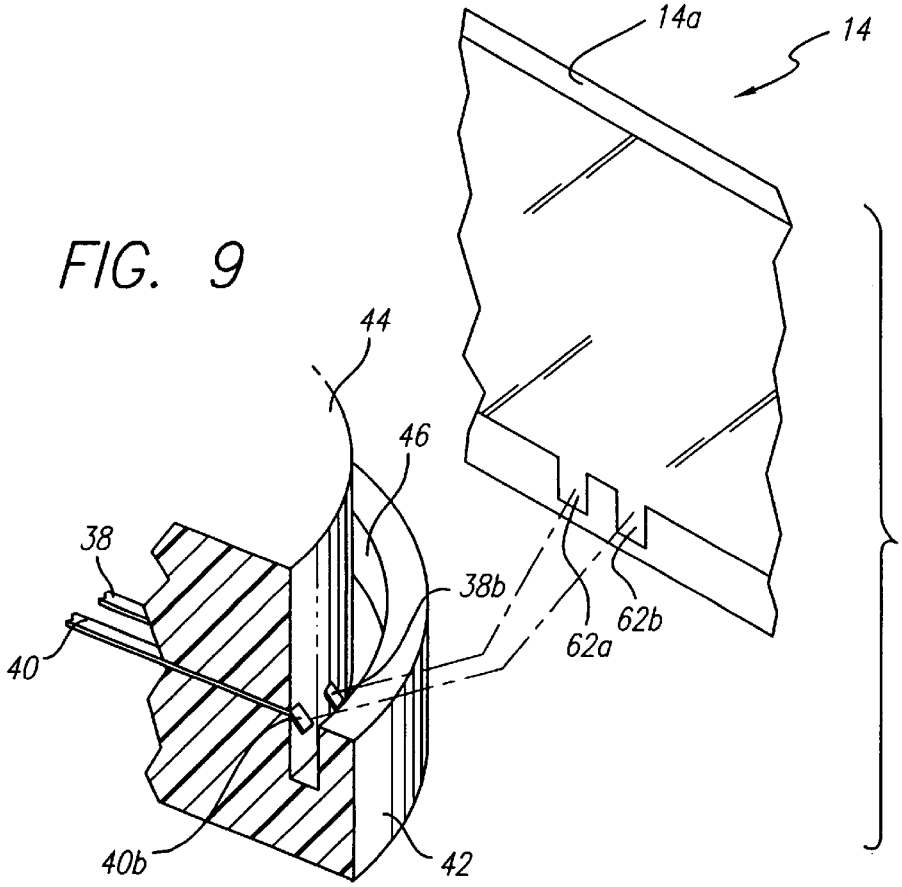
FIG. 9 is an exploded view of a section of the front portion of the housing and the electroluminescent sheet, in accordance with a first preferred embodiment of the present invention.

In the first preferred embodiment, the lamp or light emitting device is an electroluminescent sheet 14. Electroluminescent sheets are well known in the art. A typical electroluminescent sheet includes a phosphor sandwiched between two conducting surfaces, at least one of which is transparent or opaque. The two conducting surfaces are electrically connected to a source of electrical energy. As a result of the potential between the two conducting surfaces, the phosphor emits light which is proportional to the strength of the potential and the frequency. It will be appreciated by those skilled in the art that many types and varieties of electroluminescent materials and configurations are known in the art. Any electroluminescent material is within the scope of the present invention. The electroluminescent sheet 14 preferably includes electrical contacts 62*a* and 62*b* that are electrically connected to the two conducting surfaces, and are adapted for engagement with the second ends 38*b* and 40*b* of the electrical conductors 38 and 40, as shown in FIG. 9. The electroluminescent sheet 14 is preferably flexible, and can thereby be positioned and held in the interior 52 of the outer cover 16 such that the outer surface of the electroluminescent sheet 14 is adjacent the inside surface of the outer cover 16. The electroluminescent sheet 14 can also include a protective layer 14*a* affixed thereto. It will be understood that the electroluminescent material used does not have to be in the form of a sheet, for example, a plurality of electroluminescent fibers can be used.

Figure 11:
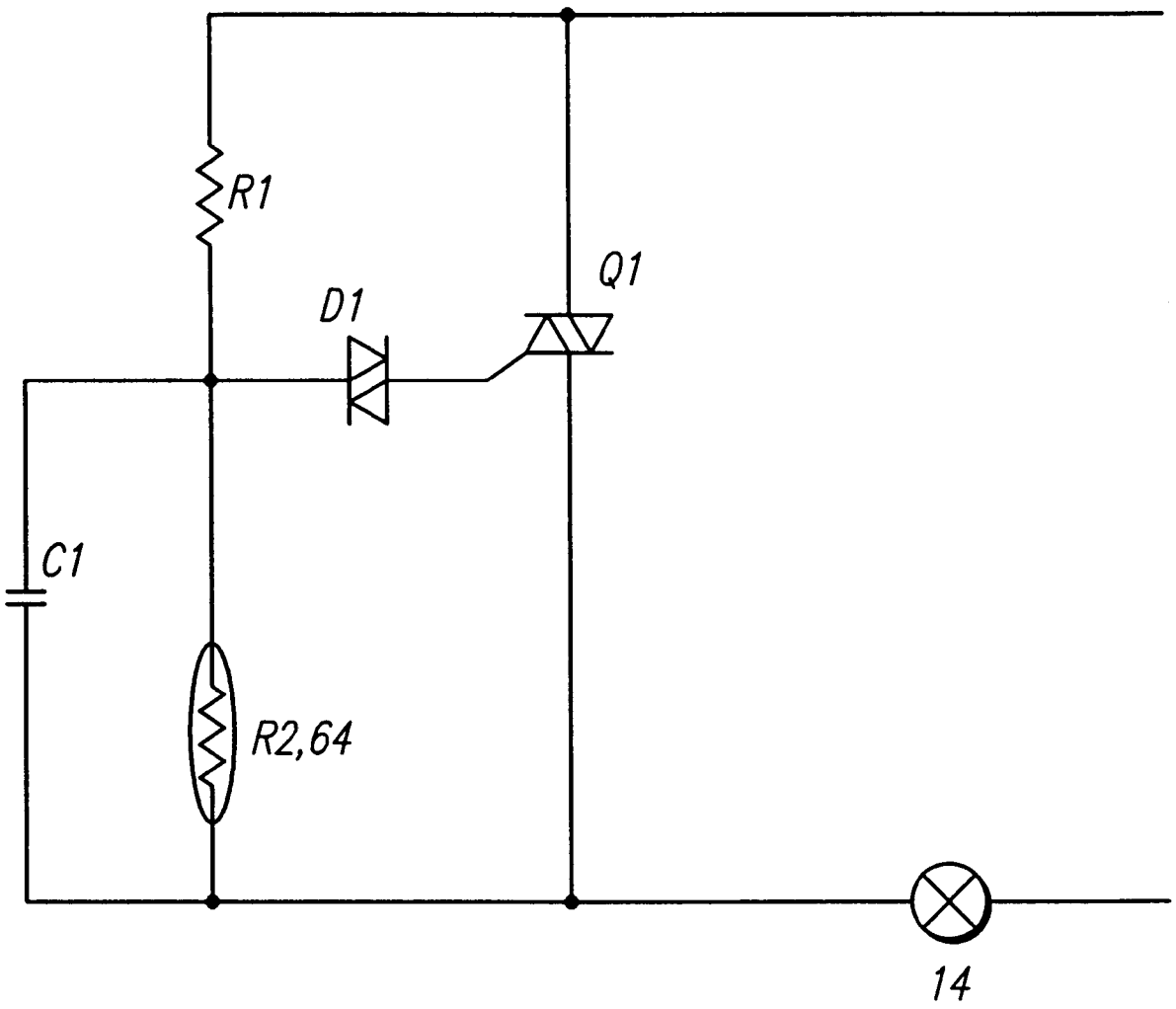
FIG. 11 is a schematic of a conventional photocell switching circuit.

In the first preferred embodiment, the assembly 10 further includes a switching circuit. Preferably, the switching circuit is a light sensor switching circuit that includes a photocell sensor 64 or the like, as shown in FIG. 11. In the first preferred embodiment, the photocell sensor 64 is located on the bottom of the base unit 34, as shown in FIG. 4B, however, the photocell sensor 64 can be located on the housing 12 as desired. Alternatively, the sensor 64 can be remote from the assembly 10.

Switching circuits are well known in the art, and the switching circuit employed is not a limitation of the present invention. FIG. 11 illustrates a typical photocell circuit including a resistor R1, CDS R2 (photocell), capacitor C1, trigger diode D1 and a triac Q. The values of the various switching circuit components are subject to the design considerations of the lighting device, including the type of lighting element used.

Figure 10:
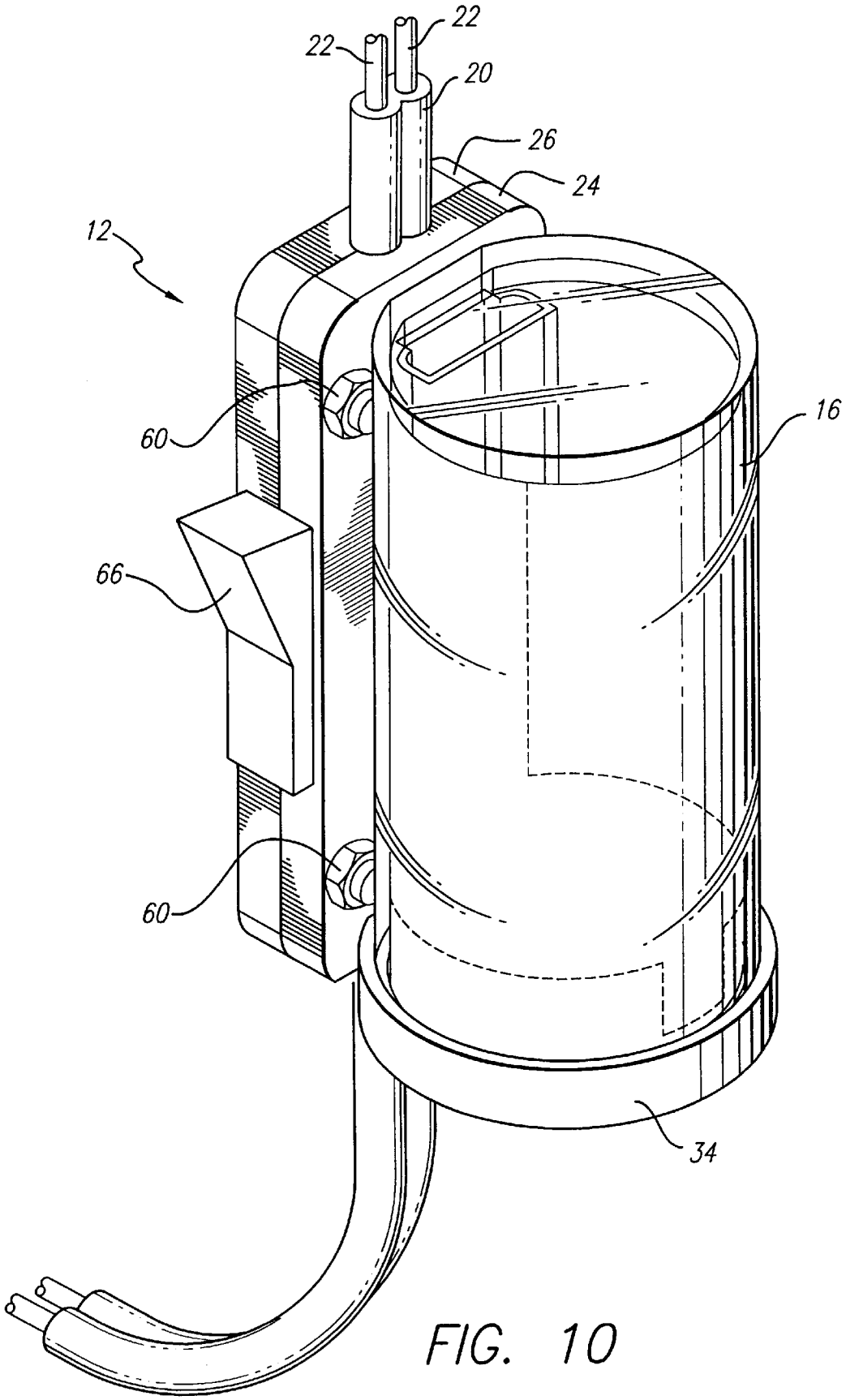
FIG. 10 is a perspective view of a fully assembled light assembly, including a manual switch, clamped on an electrical cord in accordance with an alternative embodiment of the present invention.

As shown in FIG. 10, in an alternative embodiment, the switching circuit can include a manual switch 66, instead of the photocell sensor 64.

In another alternative embodiment, the light assembly 10 can omit the switching circuit. In this embodiment, the light element is always energized as long as the electrical cord to which the light assembly 10 is attached is plugged in to an electrical outlet 9.

The assembly of the light assembly 10 will now be described. The front and back portions 24 and 26 are clamped together around an electrical cord 18 such that the cord 18 is received by the cord channel 28, and the apertures 56*a* and 56*b* are axially aligned. In the first preferred embodiment, threaded fasteners 58 are slipped through the apertures 56*a* and 56*b*. A nut 60 is threaded onto the end of the threaded fasteners protruding from the front portion 24 of the housing 12, thereby securing the two halves together. It will be understood that any conventional securing device is within the scope of the present invention. For example, the front and back portion can be secured by adhesives, glue, welding, snaps, buttons, clamps; the apertures 56*a* and 56*b* can be threaded; or the halves can be hinged or pivoted together.

It will be understood, that when the front and back portions 24 and 26 of the housing 12 are secured together, the first ends 38*a* and 40*a* of the first and second electrical conductors 38 and 40 pierce the insulating cover 20 of the electrical cord 18 thereby making contact with the electrical supply wires 22 therein, as shown in FIG. 4.

Figure 8:
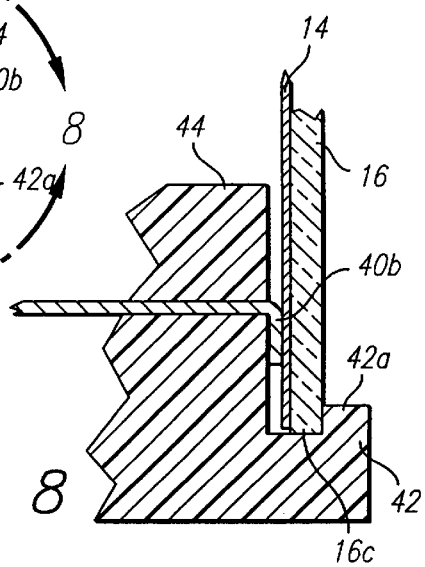
FIG. 8 is a sectional side view of the front portion of the housing taken along line 8—8 of FIG. 7 detailing the electrical conductors in engagement with the electroluminescent sheet.

In the first preferred embodiment, the electroluminescent sheet 14 is disposed in the interior 52 of the outer cover 16. The outer cover 16 is then engaged with the front portion 24 of the housing 12 by slidably engaging the mounting member 50 and slot 48 of the outer cover 16 with the mounting portion 36 of the front portion 24 of the housing 12. When the outer cover 16 is slid onto the base unit 34, as shown in FIG. 6, the minor portion 44 of the base unit 34 is received by at least a portion of the interior 52 of the outer cover 16, the bottom edge 16*c* is received by the mounting channel 46, and the second ends 38*b* and 40*b* of the first and second conductors 38 and 40 are electrically engaged to electrical contacts 62*a* and 62*b* of the electroluminescent sheet 14, as best shown in FIG. 8, such that current can be conducted from the electrical conductors 38 and 40 to the electroluminescent sheet 14 or other light emitting device. The outer cover 16 compresses the electroluminescent sheet 14 and the electrical contacts 62*a* and 62*b* thereon against the second ends 38*b* and 40*b* of electrical conductors 38 and 40 thereby electrically communicating the electroluminescent sheet 14 with the current supply wires 22 of the electrical cord. In the first preferred embodiment, the second ends 38*b* and 40*b* of the electrical conductors 38 and 40 are spring resilient as shown in FIGS. 6 and 8, thereby providing substantial electrical contact with the electrical contacts 62*a* and 62*b*.

It should be understood that the light assembly 10 can be positioned at any desirable point along the electrical cord 18, and that the light assembly 10 provides light at the point along the cord where the tap is located. It should be further understood that the light assembly 10 does not have a conventional cord or plug, but has an electrical tap that electrically connects the light emitting device to the electrical cord at the selected point along the electrical cord, and that the light assembly 10 is not independently positionable from the electrical cord 18 once the tap is made.

Figure 13:
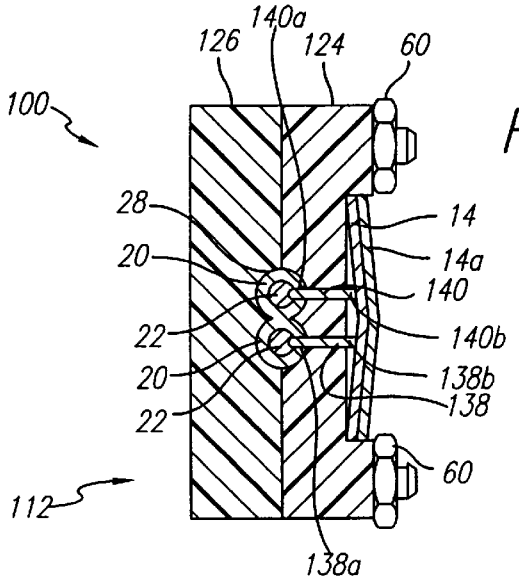
FIG. 13 is a bottom sectional plan view of the light assembly taken along line 13—13 of FIG. 12.
Figure 12:
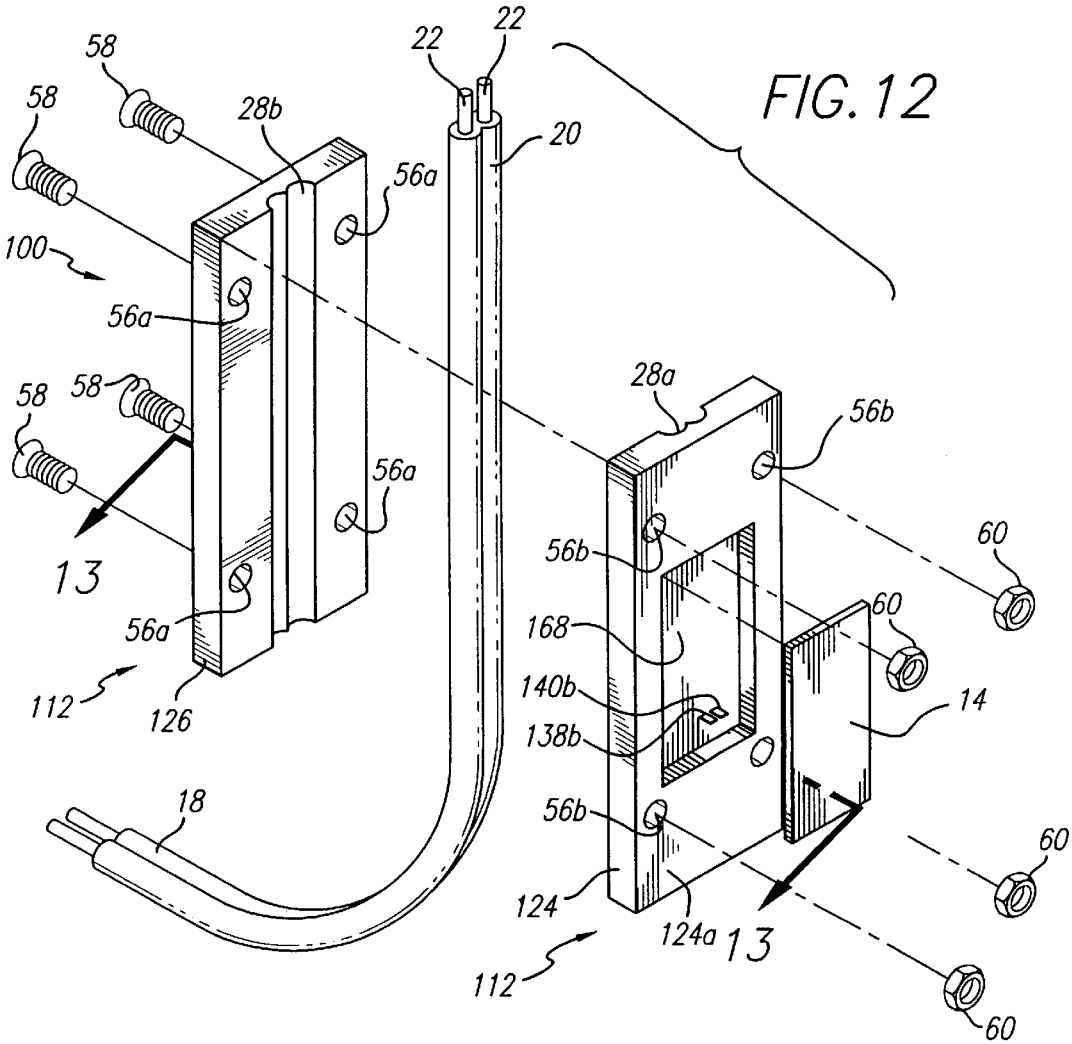
FIG. 12 is an exploded perspective view of the separate components of a light assembly, including front and rear portions of the housing and the electroluminescent sheet, in accordance with a second preferred embodiment of the present invention.
Figure 14:
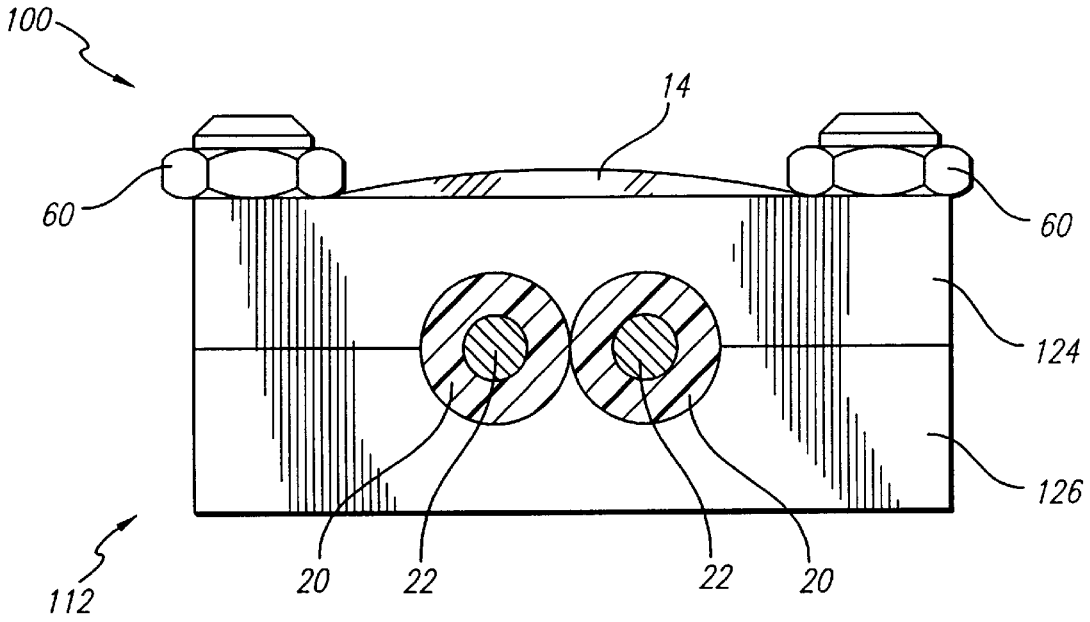
FIG. 14 is a bottom plan view of the light assembly of FIG. 12.

Referring to FIGS. 12–14, a second preferred embodiment of a light assembly 100 is shown. Same or similar index numbers denote same or similar components as in the first preferred embodiment 10. In the second preferred embodiment, the light assembly 100 includes a housing 112 having front and back portions 124 and 126 that cooperate to form a cord channel 28, and an electroluminescent sheet 14.

Preferably, the front side 124*a* of the front portion 124 of the housing 112 has a recess 168 formed therein that is adapted to receive the electroluminescent sheet 14, as shown in FIG. 12. Preferably, the electroluminescent sheet 14 is embedded in the front portion 124 of the housing 112 during manufacture. Alternatively, the electroluminescent sheet 14 can be secured in the recess 168 by adhesives, a clear or translucent cover, or other methods of securing known to those skilled in the art.

The front portion 124 of the housing 112 has embedded therein a pair of electrical conductors 138 and 140 each with first and second ends 138*a*, 138*b* and 140*a*, 140*b*. The first ends 138*a* and 140*a* of the electrical conductors 138 and 140 protrude into the cord channel 28 and are preferably sharp, thereby being adapted to pierce the insulation cover 20 of an electrical cord 18, as described above. The second end 138*b* and 140*b* of the electrical conductors 138 and 140 extend into the recess 168, thereby making contact with the electroluminescent sheet 14, as shown in FIG. 13.

Figure 15:
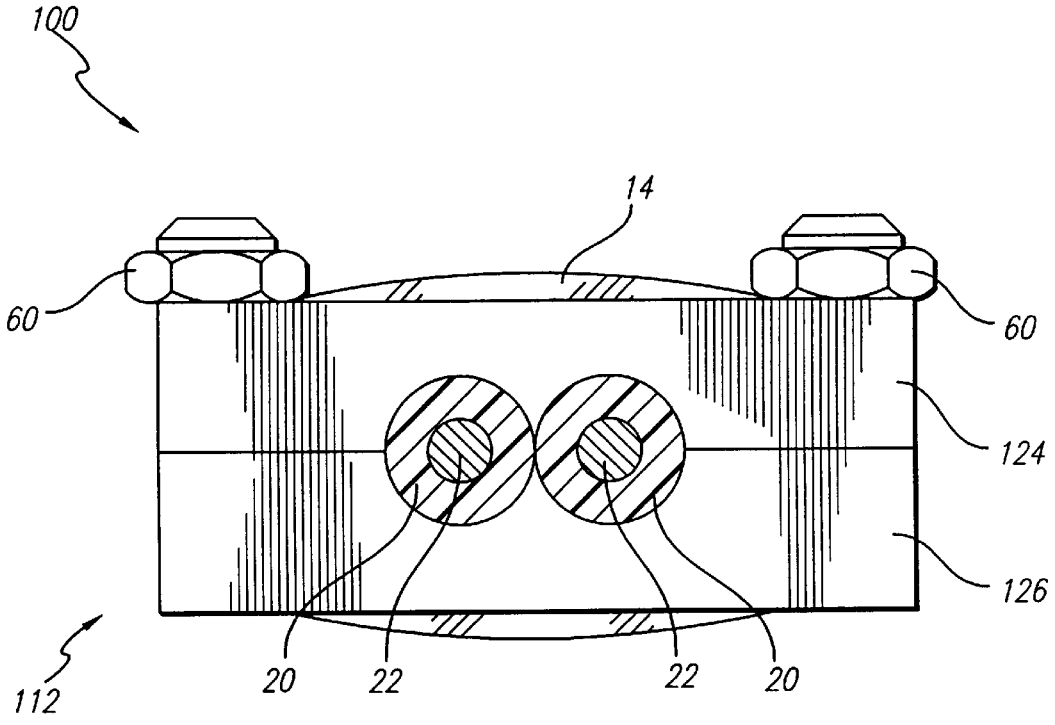
FIG. 15 is a bottom plan view of an alternative embodiment showing 2 electroluminescent sheets.

As shown in FIG. 15, in an alternative embodiment, a light assembly 180 can include electroluminescent sheets 14 in both the front 124 and back 126 portions of the housing 112, thereby requiring two pairs of electrical conductors.

Although embodiments of the present invention which employ an electroluminescent light emitting device have been illustrated herein, the invention is not limited to such embodiments. For example, the light assembly can be adapted to employ an incandescent, neon or fluorescent lighting element, or a LED. All such light emitting devices are within the scope of the present invention.

The embodiments of the present invention recited herein are intended to be merely exemplary and those skilled in the art will be able to make numerous modifications to them without departing from the spirit of the present invention. All such modifications are intended to be within the scope of the present invention as defined by the claims appended hereto.

What is claimed is:

1. A light assembly adapted to be removably positioned on an electrical cord having a length, at any point along said length, said light assembly comprising:

(a) a pair of electrical conductors adapted to tap into said electrical cord at a point; and (b) an electroluminescent sheet which electrically engages said pair of electrical conductors, wherein said light assembly is adapted to be positioned to provide light at said point along said electrical cord.

2. An electrical appliance including an electrical cord having a length and first and second opposite ends, which at said first end is electrically connected to said electrical appliance and at said second end is plugged into an electrified electrical outlet, wherein the improvement comprises:

a light assembly having an electrical tap and a light emitting device, wherein said electrical tap electrically connects said light emitting device to said electrical cord at a selected point along said length of said electrical cord.

3. The electrical appliance of claim 2 wherein said light emitting device is an electroluminescent sheet.

4. A light assembly adapted to be removably affixed to an electrical cord having a length, at any point along said length, said electrical cord having opposite ends and an insulation cover surrounding two electrical supply wires, said light assembly comprising:

(a) a housing, said housing having defined therein a cord channel adapted to receive said electrical cord, and said housing comprising first and second electrical conductors each having a first and second end, respectively, wherein said first ends of said first and second electrical conductors protrude into said cord channel, and (b) an electroluminescent sheet in electrical communication with said first and second electrical conductors.

5. The light assembly of claim 4 wherein said first end of said first electrical conductor and said first end of said second electrical conductor are each adapted to pierce said insulation cover of said electrical cord for electrical connection with said electrical supply wires.

6. The light assembly of claim 5 wherein said first and second electrical conductors are in electrical communication with said electroluminescent sheet.

7. The light assembly of claim 6 wherein said housing comprises opposing front and back portions, wherein said front and back portions are secured to one another and cooperate to form said cord channel, and wherein said front and back portions each have a portion of said cord channel defined therein.

8. The light assembly of claim 7 further comprising an outer cover that defines an interior, wherein said outer cover engages said front portion of said housing, and wherein said electroluminescent sheet is disposed in said interior of said outer cover.

9. The light assembly of claim 8 wherein said front portion of said housing comprises a base unit through which said first and second electrical conductors extend, said base unit comprising a major portion and a minor portion, and wherein said second ends of said first and second electrical conductors protrude from said minor portion of said base unit.

10. The light assembly of claim 9 wherein said front portion of said housing further comprises a mounting portion adapted to slidably engage said outer cover.

11. The light assembly of claim 10 wherein said outer cover is slidably engaged with said mounting portion.

12. The light assembly of claim 11 further comprising a switching circuit in electrical communication with said electroluminescent sheet.

13. The light assembly of claim 12 wherein said switching circuit is a light sensor switching circuit.

14. The light assembly of claim 6 wherein said electroluminescent sheet comprises a plurality of electrical contacts in electrical connection with said second ends of said first and second electrical conductors.

15. In combination:

(a) said electrical cord, and (b) the light assembly of claim 4 removably affixed to said electrical cord at a point intermediate said first and second ends.

16. The light assembly of claim 7 wherein said front portion of said housing has a recess formed therein, said recess being adapted to receive said electroluminescent sheet.

17. The light assembly of claim 16 further comprising a switching circuit in electrical communication with said electroluminescent sheet.

18. The light assembly of claim 17 wherein said switching circuit is a light sensor switching circuit.

19. The light assembly of claim 16 wherein said electroluminescent sheet comprises a plurality of electrical contacts in electrical connection with said second ends of said first and second electrical conductors.

* * * * *